United States Patent [19]

Meyeroff

[11] 4,445,563

[45] May 1, 1984

[54] ADJUSTABLE WINDOW STRUCTURE

[76] Inventor: Chester Meyeroff, 514 Waterview Dr., Cedarhurst, N.Y. 11516

[21] Appl. No.: 393,759

[22] Filed: Jun. 30, 1982

[51] Int. Cl.[3] ..... A47H 3/00

[52] U.S. Cl. ..... 160/369; 160/368 R; 160/374

[58] Field of Search ..... 160/225–228, 160/354, 368 R, 372, 374, 369, 402, 383

[56] References Cited

U.S. PATENT DOCUMENTS

| | | | |
|---|---|---|---|
| 1,190,676 | 7/1916 | Roth, Jr. | 160/227 |
| 1,810,044 | 6/1931 | Harris, Jr. | 160/226 |
| 1,942,776 | 1/1934 | Schafer | 160/369 |
| 2,017,539 | 10/1935 | Kaplan | 160/368 R |
| 3,058,518 | 10/1962 | Housman | 160/402 |
| 3,529,653 | 8/1970 | Fey, Jr. | 160/383 |

*Primary Examiner*—Peter M. Caun

[57] ABSTRACT

An adjustable window structure formed of angle members connected to define a perimeter support structure in which the length of at least two opposite sides is made variable in size by using telescopically nested angle members on those sides, to allow the sides of the adjustable structure to be pressed firmly into contact with a window frame. The nested angle members are held together by resilient clamping members formed as U-shaped channels to fit over the edges of the angle members to maintain a high frictional engagement with and between the angle members. A flexible sheet extends across the support structure, and the edges of the sheet are folded around one edge of the angle members and locked into place by the clamping members.

8 Claims, 7 Drawing Figures

Fig. 5.
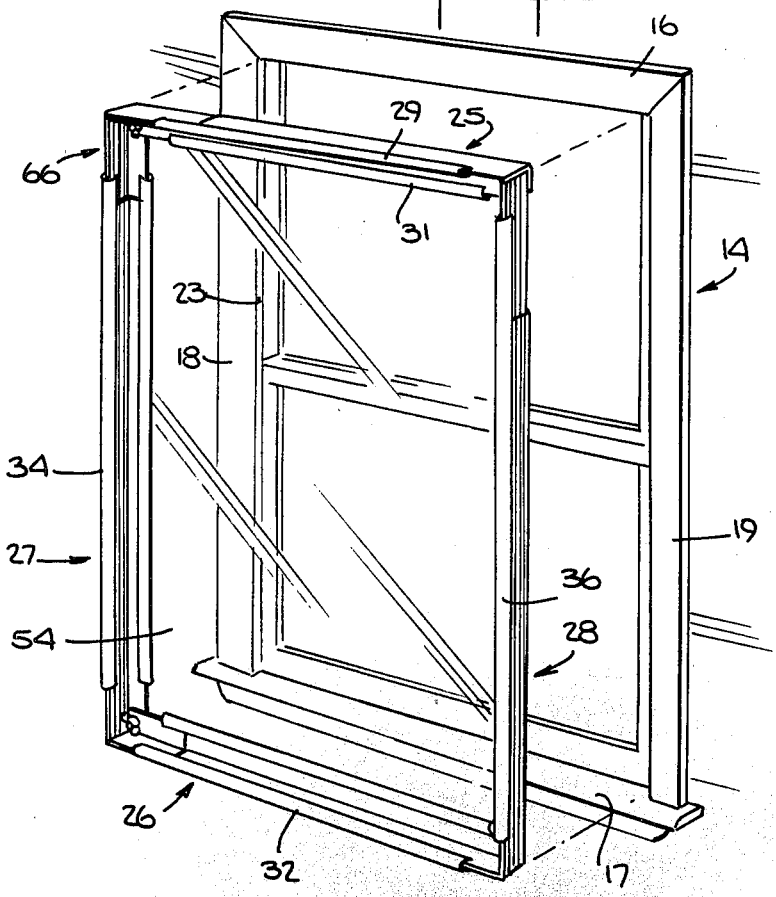
Fig. 7.
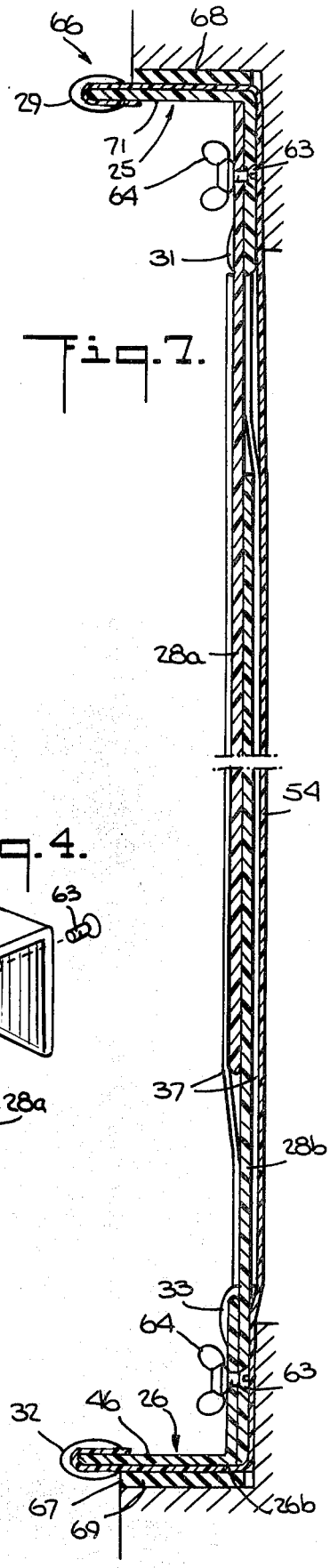
Fig. 4.
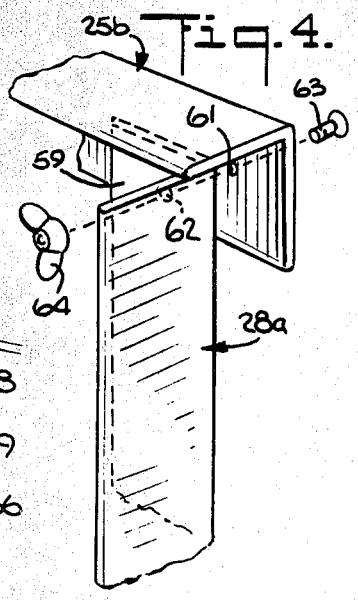
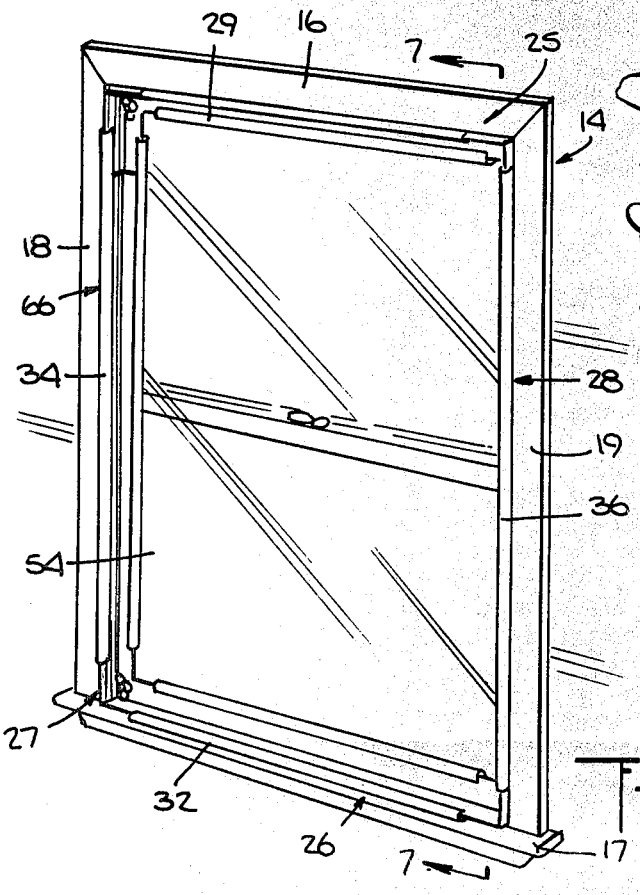
Fig. 6.

ADJUSTABLE WINDOW STRUCTURE

BACKGROUND OF THE INVENTION

This invention relates to window structures that can be adjusted to fit window frames or recesses of different sizes by means of telescoping sides formed of angle merbers resiliently clamped together by edge clamps. In particular, the invention relates to an adjustable window structure that can easily be assembled and forced into place within the confines of a window frame or recess and can as easily be removed for storage and in which the edge clamps that hold the telescoping sides together also hold the edges of flexible sheet material constituting either a pane or screen.

OBJECTS AND SUMMARY OF THE INVENTION

It is one of the objects of this invention to provide a simple window structure that can be adjusted to engage a window frame so as to be held in place by friction.

Another object is to provide an adjustable window structure in which a sheet of flexible plastic can be attached by means of resilient clamping channel members to the edges of telescopically nested angle members that define a perimeter support.

A further object is to provide an adjustable window structure in which the same resilient clamping and channel members that hold the flexible sheet on the perimeter support also hold the nested angle members in any position in which they can be set to engage a window frame with sufficient friction to remain firmly in place.

A further object is to provide an adjustable window structure suitable for easy engagement with and removal from a window frame or the like and in which either flexible plastic sheet material that is impervious to air or a sheet of cloth-like screen material can be held in place by the same channel members of U-shaped cross section that hold the sides of the perimeter support in proper relationship to fit the window frame snugly.

Further objects will become apparent from the following specification together with the drawings.

In accordance with this invention, angle members, preferably of rigid plastic, are joined together to form sides of perimeter support means. At least one pair of sides is made adjustable by forming each adjustable side of separate angle members held together in nested telescopic relationship by channel members of suitable resilient material having a generally U-shaped cross section and placed over the edges of the angle members to press the angle members together with sufficient force to generate the necessary friction to keep them in any selected telescopic relationship. The support means can thus be adjusted to engage snugly a window frame to which the structure is to be attached.

The perimeter support means provide support for a sheet of flexible material, which may be plastic that is substantially impervious to air or may be a cloth-like screen material, so that the sheet can extend over the open area defined by the perimeter with the edges of the sheet folded around one edge of each of the angle members to be held in place by the resilient clamping channels on the edge.

BRIEF DESCRIPTION OF THE DRAWINGS

FIG. 4 is a fragmentary, partially exploded view of one corner of an adjustable window structure assembled from the components in FIG. 1.

FIG. 5 is a perspective view of an adjustable window structure according to this invention in position for assembly with the window, the window structure including a sheet of transparent plastic material.

FIG. 6 is a perspective view of the adjustable window structure of FIG. 5 fitted into the window frame.

FIG. 7 is a cross sectional view of part of the window structure in FIG. 6 taken along the plane 7—7.

DETAILED DESCRIPTION OF THE INVENTION

Figure 1:
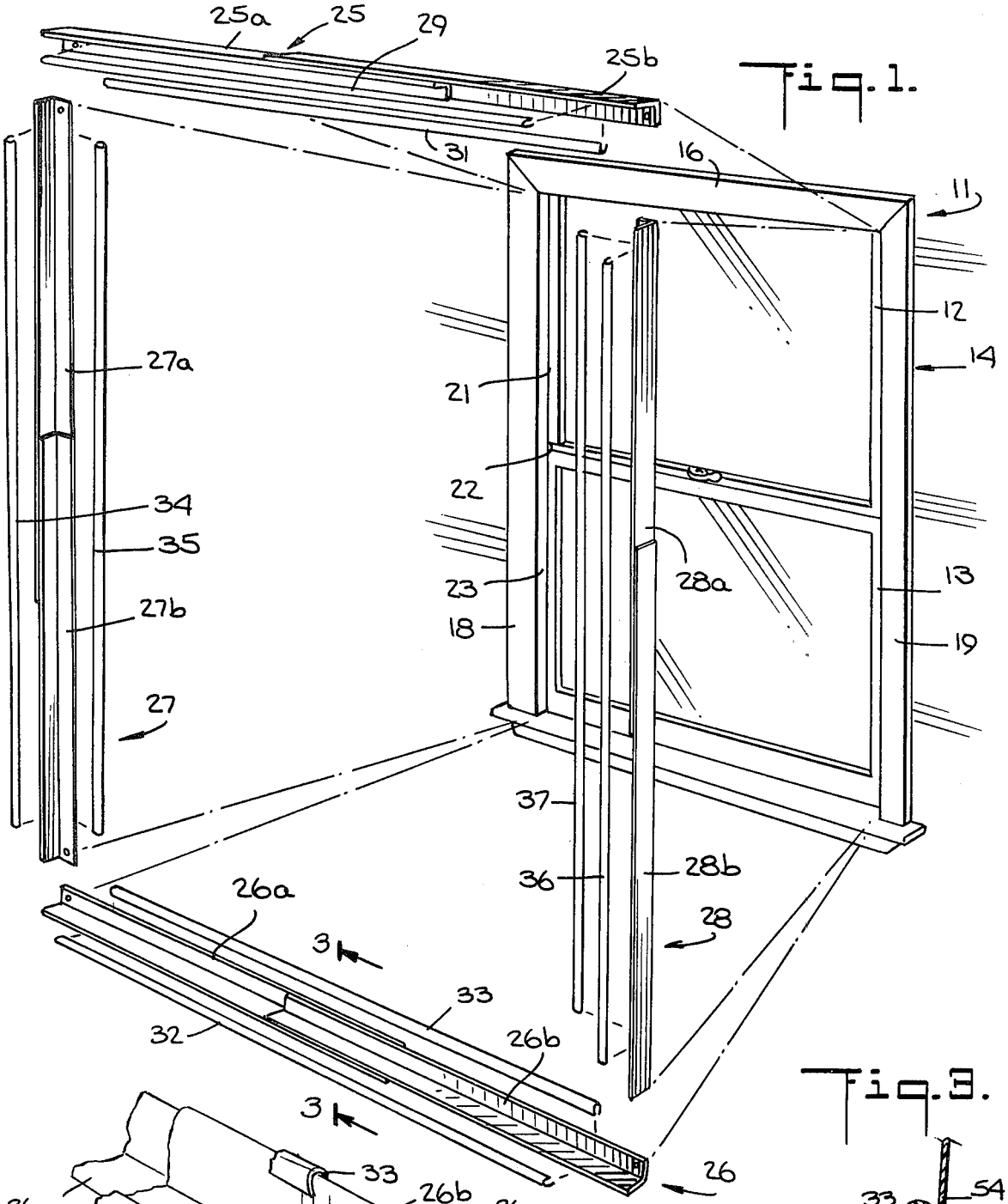
FIG. 1 is a perspective view of a window for a building and a partially exploded representation of members forming a perimeter structure to support flexible material in juxtaposition with the window.

FIG. 1 shows a typical window 11 having an upper sash 12 and a lower sash 13 slidably mounted in a frame 14. The frame includes a top member 16, a bottom member 17, which is usually referred to as a sill, and two side members 18 and 19. In accordance with the usual construction of such windows, the sash 12 is guided in a track 21 in the side member 18 and a corresponding track that is not visible in this drawing in the other side member 19. The lower sash 13 is similarly guided in a track 22 in the side member 18 and a corresponding track (not visible) in the other side member 19.

The frame members 16–19 define a window area and each of them has a surface that faces inwardly toward that area. Only the upper surface of the sill 17 and the surface 23 of the side member 18 are visible in FIG. 1, but these surfaces together with the unseen, inwardly facing surfaces on the top member 16 and the other side member 19 define a shallow recess into which the adjustable window of the present invention can be inserted and within which it will be firmly held. The adjustable structure includes perimeter support means with four sides 25–28 arranged as a first pair of sides 25 and 26, which are opposite each other and located at the top and bottom of the adjustable structure, and a second pair of opposite sides 27 and 28, which extend vertically between the ends of the top and bottom sides 25 and 26. In this embodiment, each of the sides consists of a pair of telescopically nested angle members identified by the same references numerals as the respective sides with the addition of the postscripts a and b. These angle members may be made of any suitable material, provided it has sufficient rigidity to furnish the necessary support and that the juxtaposed nested surfaces engage each other with sufficient friction to prevent the telescopic relationship changing once the adjustable structure is inserted in the frame 14. A thermoplastic material such as Lucite is suitable and has the additional advantages of not tending to mar the surface of the window frame 14, and of being sufficiently flexible so that the juxtaposed surfaces thereof are forced into good frictional contact when they are clamped together in nested relationship.

In order to hold the two angle members **25*a* and 25*b* in proper relationship to each other, two resilient clamping channel members 29 and 31 are fitted over the two edges of the angle members. These channel members have a U-shaped cross section and are made of a material, such as polyethelene, that provides sufficient resilience to clamp the edges of the angle members 25a and 25b firmly together. While only a relatively short length of the channel members 29 and 31 may be required to grip the edges of the angle members 25a and 25b with sufficient force, it is desirable, especially if the adjustable structure is to be used as a storm window, that the channel members extend substantially the entire length of the side 25. The other sets of angle members are held together by similar resilient clamping channel members 32–37**.

Figure 2:
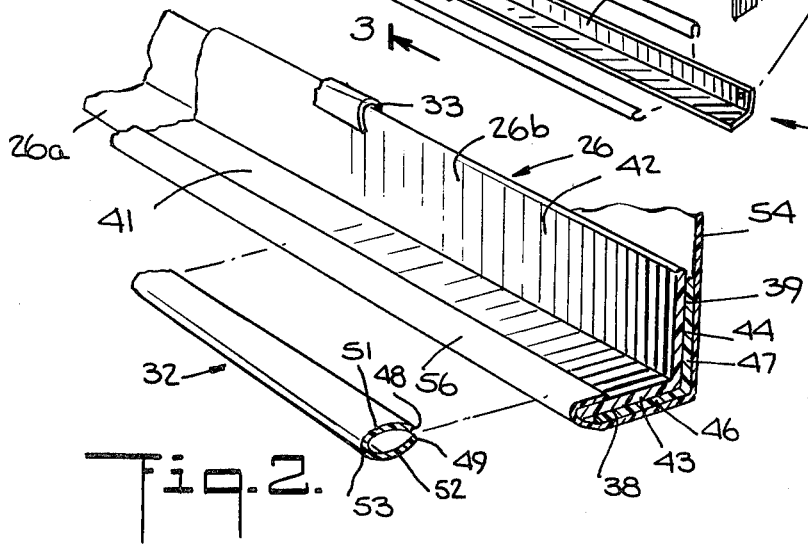
FIG. 2 is a perspective view of a fragment of the members forming one side of the support structure in FIG. 1.

FIG. 2 shows a small part of the side 26 in greater detail. As may be seen, the angle members 26a and 26b are closely nested together so that the outer surfaces 38 and 39 of the two flanges 41 and 42 that make up the angle member 26b are firmly in contact with the inner surfaces 43 and 44, respectively, of the flanges 46 and 47 that make up the angle member 26a. The juxtaposed surfaces are firmly pressed together by the channel members 32 and 33, only a short length of each of which is shown in FIG. 2. The cross sections of these channel members may be considered to be U-shaped, but it is desirable that the edges thereof, such as the edges 48 and 49 of the channel member 32 be closer together than regions 51 and 52 closer to the bight 53. In order to prevent any tendency for the channel member to slip off of the edges of the flanges 41 and 46, the distance between the inner surfaces of the channel member 32 and the regions 51 and 52 should be at least as great as, and preferably slightly greater than, the combined thicknesses of the flanges. It will also be noted that the nesting relationship of the angle members 26a and 26b causes their respective edges to be slightly offset with respect to each other, and the depth of the channel member 32 and all of the other channel members from the outer edges 48 and 49 to the bight 53 should be great enough to extend beyond the edges of the angle members and on to the flat surfaces of the respective flanges 41 and 46.

FIG. 2 also shows a fragment of a sheet of flexible material 54 folded over the edges of the flanges 41 and 46 and extending along the outer surface of the flange 46 and the outer surface of the flange 47. The region of the material 54 adjacent the edge 56 is held fast by the same clamping force of the clamping member 32 that holds the flanges 41 and 46 firmly in contact with each other. Although only a small fragment of the sheet 54 is shown, it is to be understood that this sheet extends over the entire area bounded by the four sides 25–38 in FIG. 1, and thus over substantially the entire area bounded by the inner perimeter of the frame 14.

The nature of the material 54 depends on the use to which it will be put. If the adjustable window structure is to be a storm window, the material 54 should be impervious to air, as well as being flexible. Sheets of polyethelene are suitable for that purpose and are quite transparent.

Figure 3:
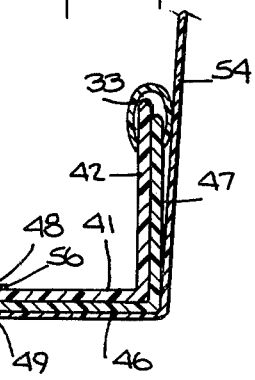
FIG. 3 is a cross sectional view of one side of the structure in FIG. 1 along the plane 3—3.

FIG. 3 shows an end cross sectional view of the structure in FIG. 2. In FIG. 3, the clamping channel member 32 is shown pressed over the edge region of the sheet 54 to hold that edge region and the flanges 41 and 46 firmly assembled. The other clamping channel member 33 only needs to hold the flanges 42 and 47 firmly in contact with each other, since the sheet 54 does not extend under the clamping channel member 33.

FIG. 4 shows one corner of the perimeter support means and illustrates one way of assembling the angle members 25 and 28 at that corner. The arrangement in FIG. 4 is such that the inner surface 57 of one of the flanges 58 of the angle member 25b faces the outer surface of one of the flanges 59 of the angle member 28a. Holes 61 and 62 are bored through the flanges 58 and 59 to admit a screw 63 to hold the angle members 25b and 28a together. The screw 63, in turn, may be held in place within the holes 61 and 62 by any convenient means, such as a wing nut 64.

FIG. 5 shows a completely assembled adjustable window structure 66 comprising the four sides 25–28 and the sheet of material 54 in the form of a polethylene web attached thereto by the clamping channel members 29, 32,34, and 36 holding the respective top, bottom, left, and right edges of the sheet of material 54. The sides 25–28 have been adjusted telescopically to conform substantially to the inner perimeter of the frame 14 bounded by the sill 17, the surface 23, and corresponding surfaces in the top frame member and the other side member 19.

FIG. 6 shows the adjustable window structure 66 set into the shallow recess bounded by the inner perimeter of the frame 14. After structure 66 has been placed in the position shown in FIG. 6, the sides 25–28 can be pressed outwardly toward the adjacent frame members to cause the structure 66 to fit snugly within the frame and to prevent it from falling out.

FIG. 7 shows a part of the structure 66 in place within a window recess 67 and includes parts of the side 28 comprising the angle members 28a and 28b, which overlap each other longitudinally sufficiently to form a sturdy nested relationship. Although most windows have a sill that extends outwardly from the lower edge, it is not necessary that such a sill be provided, and recess 67 has none. In order to assist in holding the structure 66 firmly in place within the recess 67, the sides 25–28 are provided with strips of resilient material, preferable attached to the outer surfaces of the sheet material 54. Only two such strips 68 and 69 are visible in FIG. 7 and are located adjacent the sides 25 and 26, respectively. These strips of resilient material may be foam rubber, or the like, and they increase the friction that holds the structure 66 in place. They also fill up any gaps that may exist around the perimeter support means by virtue of the fact that the sides 25–28 are made of nested angle members that only partially overlap each. This partial overlapping is illustrated by the angle members 28a and 28b. By assembling the angle members in such a way that the outer surface of one flange of each angle member faces the inner surface of the flanges of the two angle members contacted by it, and continuing this arrangement around the entire perimeter support means, one of the flanges of each angle member is substantially coplanar with one of the flanges of the other angle members, and the other flange of each angle member is perpendicular to that plane. As shown in FIG. 7, it is the edges of the perpendicular flanges 46 and 71 around which the edge regions of the flexible sheet of material 54 are wrapped to be held in place by the clamping members 32 and 29, respectively.

FIG. 7 also shows that the inner clamping members, such as the member 37 can only extend along the angle members 28a and 28b to the point of intersection with the angle members 25b and 26b. The clamping members 29 and 32 and the corresponding clamping members 34 and 36 shown in FIG. 5 can extend the full length of the edges to which they are attached, although it is not necessary that they do so.

Although it is desirable that all four of the sides 25–28 of the window structure 66 be adjustable, it is possible that two of the opposing sides could each be made of one piece of angle material and not arranged to telescope. In such a structure, size adjustment would then only be possible in one direction by the telescopically nested angle members forming those sides.

While the structure 66 has been found to be very useful as a supplemental storm window, which requires that the material 54 be impervious to air, it can also be used as a removable screen accessible from inside the building. In that case, the material 54 can be a loosely woven cloth-like material, such as the fiberglass material currently used for screens.

In addition, although the structure 66 is shown in FIG. 7 inserted into the recess 67, it could also be attached to outwardly facing surfaces of a frame somewhat similar to the frame 14 in FIG. 5 provided that, instead of the sill 17, another member similar to the member 16, 18, and 19 were across the bottom of the frame. In that case, the inner surfaces of the outwardly extending flanges of the four sides 25–28 would be pressed inwardly against the outwardly directed surfaces of the frame members.

While this invention has been described in terms of specific embodiments, it will be understood by those skilled in the art that modifications may be made therein without departing from the true scope of the invention as defined by the following claims.

What is claimed is:

1. An adjustable window structure to engage a window frame having a top frame member, a bottom frame member and two side frame members defining a window area, said structure comprising:

perimeter support means comprising a plurality of angle members;

attachment means to attach pairs of the angle members together to arrange the perimeter support means to have first and second pairs of opposite sides, the angle members that comprise at least the first pair of opposite sides being telescopically nested together, whereby the perimeter support means forming the first pair of opposite sides can be slidably adjusted to engage the frame members;

clamping means including resilient channel members extending longitudinally along substantially the entire length of each edge of the angle members forming the telescopically nested sides for exerting pressure thereon and for holding the nested sides in fixed relationship to engage the window frame members firmly;

flexible sheet material having top, bottom and side edges each folded over an edge of the angle members forming the respective sides of the perimeter support means, the clamping means embracing the respective edges of the sheet material and of the respective angle members for clamping the sheet material to the sides.

2. The window structure in claim 1 in which there are two of the angle members comprising each of the first pair of opposite sides.

3. The window structure of claim 1 in which the opposite sides of the second pair also comprise a pair of said angle members telescopically nested together.

4. The window structure of claim 1 in which the flexible sheet material is substantially impervious to air.

5. The window structure in claim 1 comprising, in addition, a strip of resilient material extending along substantially the entire length of each of the sides of the perimeter support means to form cushioning means between the perimeter support means and the window frame members.

6. The window structure of claim 1 in which each of the angle members has a first flange substantially coplanar with the first flange of each of the other angle members, and a second flange substantially perpendicular to the first flange, the strip of resilient material extending along the second flange of the respective angle members.

7. The window structure of claim 1 in which all of the angle members have the same cross sectional dimensions and are made of thermoplastic material with a mutual coefficient of friction high enough to prevent longitudinal slippage thereof relative to a nested one of said angle members.

8. The window structure of claim 1 in which the angle members defining each pair thereof overlap at one end thereof, and the attachment means attach juxtaposed flanges of each respective pair of the angle members together, each of the resilient clamping channel members extending over the edge of the other flange of each of the respective angle members and extending therealong to the region at the end of each of the sides overlapping the sides connected thereto.

* * * * *